US007663470B2

(12) United States Patent
Kimura

(10) Patent No.: US 7,663,470 B2
(45) Date of Patent: Feb. 16, 2010

(54) TRIMMING CIRCUIT AND ELECTRONIC CIRCUIT

(75) Inventor: Hiroyuki Kimura, Miyagi (JP)

(73) Assignee: Freescale Semiconductor, Inc., Austin, TX (US)

( * ) Notice: Subject to any disclaimer, the term of this patent is extended or adjusted under 35 U.S.C. 154(b) by 584 days.

(21) Appl. No.: 11/403,395

(22) Filed: Apr. 13, 2006

(65) Prior Publication Data

US 2006/0266646 A1 Nov. 30, 2006

(30) Foreign Application Priority Data

May 24, 2005 (JP) ..... 2005-150872

(51) Int. Cl.
*H01C 10/00* (2006.01)

(52) U.S. Cl. ..... 338/195; 338/200; 338/295; 257/528; 257/536

(58) Field of Classification Search ..... 338/195, 338/200, 201, 295; 257/528, 536
See application file for complete search history.

(56) References Cited

U.S. PATENT DOCUMENTS 4,364,006 A * 12/1982 Makabe et al. ..... 323/353
5,323,137 A * 6/1994 Kimura et al. ..... 338/196
6,201,288 B1 * 3/2001 Iwasaki et al. ..... 257/528
6,768,620 B2 * 7/2004 Kim et al. ..... 361/59
7,053,751 B2 * 5/2006 Itoh ..... 338/333

FOREIGN PATENT DOCUMENTS

JP 2003-203231 7/2003
JP 2004-79158 3/2004

* cited by examiner

*Primary Examiner*—Kyung Lee
(74) *Attorney, Agent, or Firm*—Charles Bergere

(57) ABSTRACT

A trimming circuit and an electronic circuit that decreases the resistance of an activated transistor while reducing the number of resistors. The trimming circuit includes a plurality of series-connected units. Units for respectively changing adjusting resistances of Runit/2, Runit/4, Runit/8, and Runit/16 are each formed by a transistor, a series-connected resistor circuit, which has resistance Rt and which is connected in series to the transistor, and a parallel-connected resistor circuit, which has resistance Rm and which is connected to the transistor and the series-connected resistor circuit. The resistances Rm and Rt are determined in each unit such that the difference between the resistance Rm when the transistor is off and the resistance of the entire unit when the transistor is on determines the adjusting resistance.

6 Claims, 4 Drawing Sheets

| n | ΔR | m | Rm | t | Rt | TOTAL |
|---|---|---|---|---|---|---|
| 4 | Runit/4 | 1 | Runit | 3 | 3Runit | 4 |
| | | 2 | Runit/2 | 1/2 | Runit/2 | 4 |

| n | ΔR | m | Rm | t | Rt | TOTAL |
|---|---|---|---|---|---|---|
| 8 | Runit/8 | 1 | Runit | 7 | 7Runit | 8 |
| | | 2 | Runit/2 | 3/2 | 3Runit/2 | 5 |
| | | 4 | Runit/4 | 1/4 | Runit/4 | 8 |

| n | ΔR | m | Rm | t | Rt | TOTAL |
|---|---|---|---|---|---|---|
| 16 | Runit/16 | 1 | Runit | 15 | 15Runit | 16 |
| | | 2 | Runit/2 | 7/2 | 7Runit/2 | 7 |
| | | 4 | Runit/4 | 13/4 | 3Runit/4 | 8 |

-PRIOR ART-

-PRIOR ART-

TRIMMING CIRCUIT AND ELECTRONIC CIRCUIT

BACKGROUND OF THE INVENTION

The present invention relates to a trimming circuit for use in, for example, an electronic circuit such as a semiconductor device and for adjusting the electrical characteristics of the electronic circuit.

Japanese Patent Laid-Open Publication No. 2004-79158 describes a trimming circuit that is used to finely adjust the characteristics of an electronic circuit such as a semiconductor device. In this patent publication, a trimming circuit is used as a deviation temperature detection circuit of a temperature detector. The trimming circuit described in the patent publication may have the configuration shown in FIG. 5. The trimming circuit shown in FIG. 5 has series-connected units ua1 to ua6. The units ua1 to ua6 respectively have 32, 16, 8, 4, 2, and 1 series-connected resistors R. The resistors are connected in parallel to transistors that perform switching operations. This configuration makes it possible to control the transistor of each of the units to change the resistance in a stepped manner in a range of 0 to 64 times the unit resistance (the resistance of each resistor R) to perform trimming. This trimming circuit, however, requires as many as 63 resistors R.

As shown in FIG. 6, a trimming circuit may be configured by connecting resistors R in parallel. In this trimming circuit, units ub1 to ub6 are connected to each other in series. In the unit ub1, two series-connected resistors R are connected to a transistor in parallel. In the unit ua2, a resistor R is connected to a transistor in parallel. In the units ub3 to ub6, two, four, eight and sixteen series-connected resistors R are respectively connected in parallel to a transistor, which performs a switching operation. This configuration makes it possible to control the transistor of each of the units to change the resistance in a stepped manner in a range of 1/16 to 2 times the unit resistance (the resistance of each resistor R). The trimming circuit is formed by a smaller number of resistors R than the trimming circuit in FIG. 5, yet requires as many as 33 resistors R.

As described above, a trimming circuit requires many resistors R. Moreover, in the trimming circuit shown in FIG. 6, the resistors R are connected in parallel to transistors, which perform switching operations, in the units ub2 to ub6. Therefore, when the resistance that is adjusted is low in a unit, the resistance Ron for when the transistor is on will affect the resistance. For example, in the unit ub6 of which adjusted resistance is minimal, the transistor is connected in parallel to 16 resistors R. Assuming that the resistance Ron of the transistor is R/16, the resistance of the unit ub6 when the transistor is turned on will be R/32. Although the target resistance of the unit ub6 is set to zero when the transistor is off and set to R/16 when the transistor is on, the actual resistance is only R/32 when the transistor is off and R/16 when the transistor is on. Thus, in the prior art, the actual adjusted resistance differs greatly from the desired resistance due to the activation and inactivation of the transistor.

SUMMARY OF THE INVENTION

It is an object of the present invention to provide a trimming circuit capable of correctly and precisely adjusting resistance with a small number of resistors and an electronic circuit including the trimming circuit.

One aspect of the present invention is a trimming circuit for generating an adjusting resistance, comprising serially connected units, each unit having a different adjusting resistance. At least one of the units includes a switch element having a control terminal, a first module connected in series to the switch element, and a second module connected in parallel to the switch element and the first module. The first module and the second module are configured such that a difference between a resistance of the second module and a synthesized resistance of the first and second modules is the adjusting resistance.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4(*b*) is a diagram illustrating the configuration of a unit in the trimming circuit having an adjusting resistance of Runit/8;

FIG. 4(*c*) is a diagram illustrating the configuration of a unit in the trimming circuit having an adjusting resistance of Runit/16;

DETAILED DESCRIPTION OF THE PREFERRED EMBODIMENTS

Figure 1:
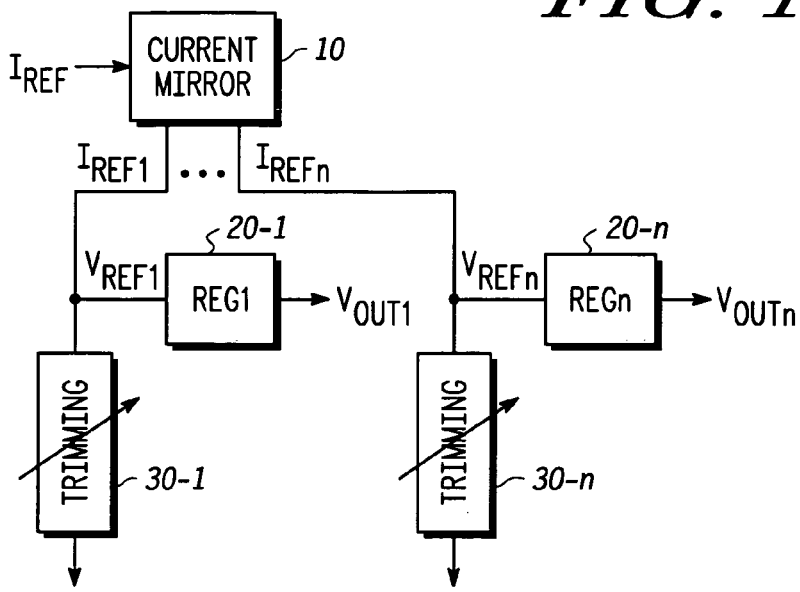
FIG. 1 is a circuit diagram of an electronic circuit according to a preferred embodiment of the present invention.

A preferred embodiment of the present invention will now be described with reference to FIGS. 1 to 4. Referring to FIG. 1, a trimming circuit according to a preferred embodiment of the present invention is applied to an electronic circuit, which functions as a reference voltage supply circuit. The trimming circuit includes a plurality of units, each including an N-channel MOS transistor and one or more resistors R having resistance Runit. The units respectively change the resistance to 2, 1, ½, ¼, ⅛ and 1/16 times the resistance Runit.

The reference voltage supply circuit to which the trimming circuit is applied first will be described with reference to FIG. 1. The reference voltage supply circuit has a current mirror circuit 10, which is supplied with reference current Iref. The current mirror circuit 10 is connected to regulators 20-1 to 20-n so that output current (Iref1 to Irefn) is supplied to the regulator 20-1 to 20-n, respectively, based on the reference current Iref supplied to the current mirror circuit 10. Trimming circuits 30-1 to 30-n are connected to the lines connecting the current mirror circuit 10 to the regulators 20-1 to 20-n, respectively. The resistances of the trimming circuits 30-1 to 30-n are finely adjusted to adjust the reference voltages Vref1 to Vrefn supplied to the regulators 20-1 to 20-n, respectively. The regulators 20-1 to 20-n thus supply operation circuits (not shown) with the voltages Vout1 to Voutn obtained by adjusting the reference voltages Vref1 to Vrefn as required.

The internal configuration of each of the trimming circuits 30-1 to 30-n will now be described with reference to FIG. 2.

The trimming circuit of this embodiment has units u1 to u6 connected in series to a base resistor circuit having resistance Rx. The base resistor circuit is provided to set a base resistance for converting output current from the current mirror circuit 10 to a reference voltage. The transistor of each of the units u1 to u6 is controlled based on this base resistance to trim the resistance. In this embodiment, the resistance adjustment is performed by assigning resistances of 2Runit, Runit, Runit/2, Runit/4, Runit/8, and Runit/16 to the units u1 to u6, respectively, as the adjusting resistances. In this embodiment, the units u1 to u6 are formed by resistors R, which have the same resistance (e.g., Runit). The configuration of the units u1 to u6 will now be described in detail.

The unit u1 connected to a resistor circuit having resistance Rx is formed by a transistor Tr1 connected in parallel to two series-connected resistors R. Accordingly, when the transistor Tr1 is off, the resistance of the unit u1 is equal to the resistance of the two series-connected resistors R (2Runit). When the transistor Tr1 is on, the resistance of the unit u1 is equal to the resistance Ron (≈0) of the transistor Tr1.

The unit u2 connected to the unit u1 is formed by a transistor Tr2 and a single resistor R connected to the transistor Tr2 in parallel. Accordingly, the resistance of the unit u2 is equal to the resistance (Runit) of the resistor R when the transistor Tr2 is off and equal to the resistance Ron (≈0) of the transistor Tr2 when the transistor Tr2 is on.

The units u3 to unit u6 are respectively formed by transistors Tr3 to Tr6, serial connection sections, which are connected in series to the associated transistors Tr3 to Tr6, and parallel connection sections, which are connected in parallel to the serial connection section and the associated transistors Tr3 to Tr6. In this embodiment, each transistor Tr3 to Tr6 functions as a switch element. The transistors Tr3 to Tr6 are each formed by an N-channel MOS transistor having a gate terminal functioning as a control terminal.

The unit u3 connected to the unit u2 is formed by a transistor Tr3, a serial connection section including a single resistor R connected in series to the transistor Tr3, and a parallel connection section (a single resistor R) connected in parallel to the transistor Tr3 and the serial connection section. Accordingly, the resistance of the unit u3 is equal to the resistance (Runit) of the resistor R of the parallel connection section when the transistor Tr3 is off. When the transistor Tr3 is on, the two resistors R are connected in parallel. Hence, the resistance of the unit u3 becomes equal to the synthesized resistance (approximately Runit/2) of the two resistors R. The resistance Ron of the transistor is subtle compared to the resistances of the resistors R and may thus be ignored.

The unit u4 connected to the unit u3 is formed by a transistor Tr4, a serial connection section, which includes three resistors R and which is connected in series to the transistor Tr4, and a parallel connection section (a single resistor R), which is connected in parallel to the transistor Tr4 and the serial connection section. Accordingly, the resistance of the unit u4 is equal to the resistance (Runit) of the single resistor R connected in parallel to the transistor Tr4 when the transistor Tr4 is off. When the transistor Tr4 is on, the resistance of the unit u4 becomes equal to a synthesized resistance (3Runit/4) of the four resistors R forming the unit u4.

The unit u5 connected to the unit u4 is formed by a transistor Tr5, a serial connection section connected in series to the transistor Tr5, and a parallel connection section connected in parallel to the transistor Tr5 and the serial connection section. The serial connection section of the unit u5 is formed by a parallel connection of two resistors R and serial connection of a single resistor R. The parallel connection section is formed by two resistors R connected in parallel to each other. Accordingly, the resistance of the unit u5 is equal to a synthesized resistance (Runit/2) of the parallel connection section of the unit u5 when the transistor Tr5 is off and is equal to a synthesized resistance (3Runit/8) of the parallel connection section and the serial connection section forming the unit u5 when the transistor Tr5 is on.

The unit u6 connected to the unit u5 is formed by a transistor Tr6, a serial connection section connected to the transistor Tr6, and a parallel connection section connected to the transistor Tr5 and the serial connection section. The serial connection section of the unit u6 includes a parallel connection of two resistors R and a serial connection of three resistors R. The parallel connection section includes two resistors R connected in parallel to each other. Accordingly, when the transistor Tr6 is off, the resistance of the unit u6 becomes equal to a synthesized resistance (Runit/2) of the parallel connection section of the unit u6. When the transistor Tr6 is on, the resistance of the unit u6 becomes equal to a synthesized resistance (7Runit/16) of the parallel connection section and the serial connection section forming the unit u6.

The trimming circuit of this embodiment has the highest resistance (reference resistance) when all the transistors Tr1 to Tr6 are off. In this case, the resistor circuit having resistance Rx, the unit u1 having resistance 2Runit, the unit u2 having resistance Runit, the units u3 and u4 both having resistance Runit, and the units u5 and u6 both having resistance Runit/2 are connected in series. Accordingly, the reference resistance is Rx+6Runit. When the transistors Tr1 to Tr6 are on, the trimming circuit has the lowest resistance. In this case, the resistor circuit with the resistance Rx, the unit u3 with the resistance Runit/2, the unit u4 with the resistance 3Runit/4, the unit u5 with the resistance 3Runit/8, and the unit u6 with the resistance 7Runit/16 are connected in series. The resistance in this case is Rx+33/16Runit.

When decreasing the resistance of the trimming circuit by 2Runit, the transistor Tr1 is turned on. When decreasing the resistance by Runit, the transistor Tr2 is turned on.

When decreasing the resistance by Runit/2, the transistor Tr3 is turned on. This changes the total resistance in the unit u3 is changed from the resistance Runit to the resistance Runit/2. This difference decreases the resistance of the trimming circuit lower by Runit/2.

When decreasing the resistance by Runit/4, the transistor Tr4 is turned on. This changes the total resistance of the unit u4 from the resistance Runit to the resistance 3Runit/4. This difference decreases the resistance of the trimming circuit by Runit/4.

When decreasing the resistance by Runit/8, the transistor Tr5 is turned on so that the total resistance of the unit u5 is changed from the resistance Runit/2 to the resistance 3Runit/8. This difference decreases the resistance of the trimming circuit by Runit/8.

When decreasing the resistance by Runit/16, the transistor Tr6 is turned on so that the total resistance of the unit u6 is changed from the resistance Runit/2 to the resistance 7Runit/16. This difference decreases the resistance of the trimming circuit by Runit/16 from the reference resistance.

In this manner, a combination of the activated ones of the transistors Tr1 to Tr6 decreases the resistance of the trimming circuit by a total of the differences in resistance of the units including the transistors which have been turned on.

Figure 3:
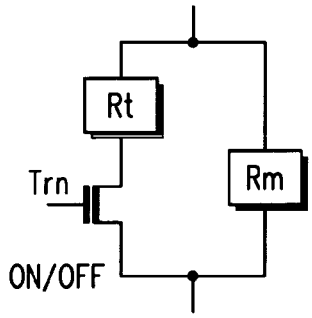
FIG. 3 is a schematic diagram of a unit in the trimming circuit.
Figure 4A:
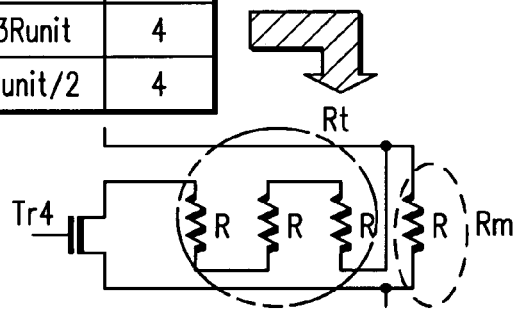
FIG. 4(*a*) is a diagram illustrating the configuration of a unit in the trimming circuit having an adjusting resistance of Runit/4.
Figure 4B:
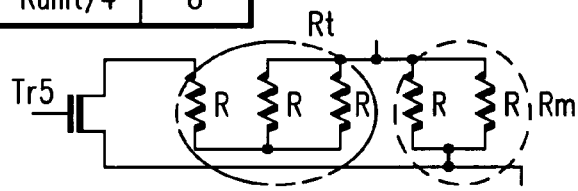
Figure 4C:
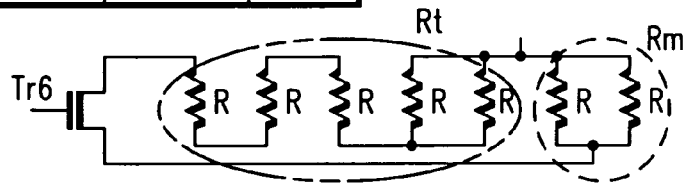
Figure 5:
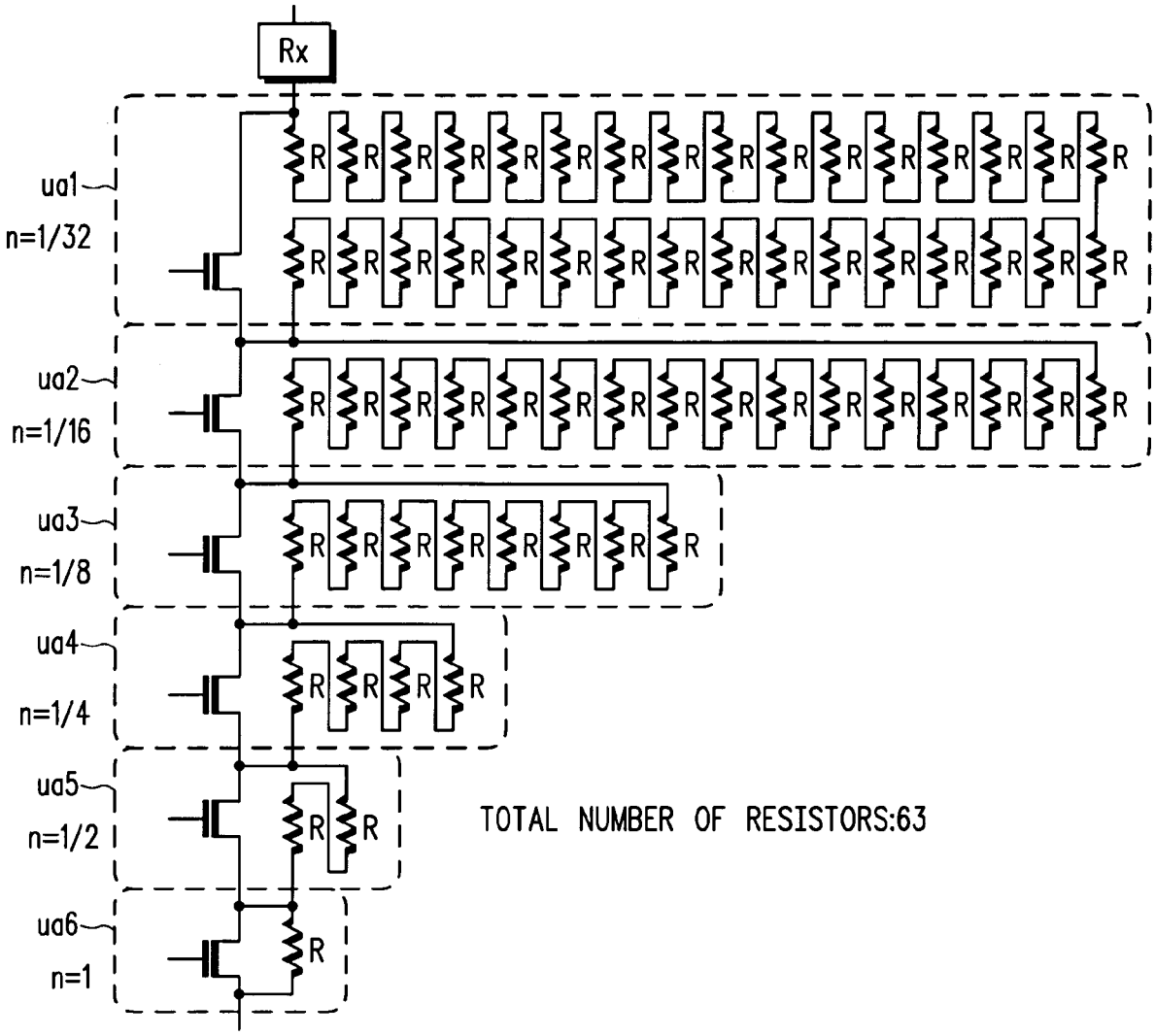
FIG. 5 is a circuit diagram of a first example of a prior art trimming circuit.
Figure 6:
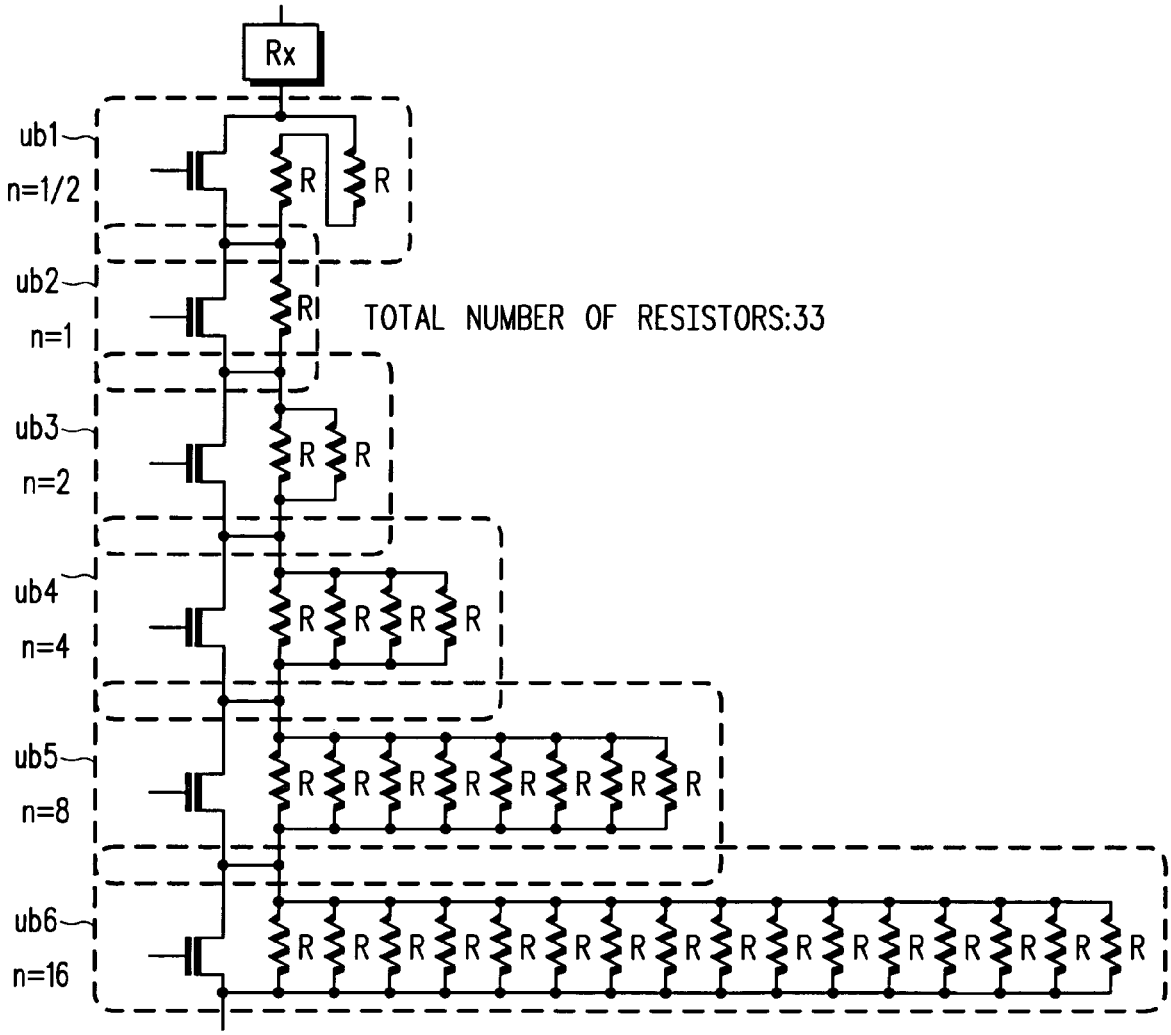
FIG. 6 is a circuit diagram of a second example of a prior art trimming circuit.

The procedures for designing the units u3 to u6 will now be described with reference to FIGS. 3 and 4. FIG. 3 is a schematic diagram for designing a predetermined unit. Each unit is formed by a series-connected resistor circuit (first module), which has resistance Rt and which is connected in series to a transistor Trn, and a parallel-connected resistor circuit (second module), which has resistance Rm and which is connected in parallel to the series-connected resistor circuit and the transistor Trn.

An adjusting resistance ΔR, which is varied by each unit, is determined by the difference between a resistance of the unit when the transistor Trn is turned on and a resistance of the unit when the transistor Trn is turned off. The resistance of the unit when the transistor Trn is off is equal to Rm. The resistance of the unit when the transistor Trn is on is equal to a resistance when Rm and Rt are connected in parallel (represented by "Rm//(Rt+Ron)"). The adjusting resistance ΔR is defined as ΔR=Runit/n, the resistance Rt of the series-connected resistor circuit is defined as Runit×t, and the resistance Rm of the parallel-connected resistor circuit is defined as Runit/m.

Thus, ΔR may be represented by the following equation.

$$\Delta R = Rm - Rm//(Rt+Ron) = Rm\hat{}2/(Rm+Rt+Ron)$$

In this equation, the resistance Ron of the transistor Trn, which is smaller than the resistance Rm of the parallel-connected resistor circuit or the resistance Rt of the series-connected resistor circuit, will be assumed to be zero. The symbol "^" indicates an exponent.

When ΔR=Runit/n, Rt=Runit×t, and Rm=Runit/m are substituted in the equation, the following equation (1) is obtained.

$$Runit/n = (Runit/m)\hat{}2/(Runit/m + Runit \times t) \quad (1)$$

Therefore, the relationship among m, n, and t is represented by the following equation (2).

$$t = (n-m)/m\hat{}2 \quad (2)$$

The procedure of forming each of the units will now be described in detail.

In the unit u3 having a target value of ΔR=Runit/2, n is equal to 2. If m=1 is satisfied, t is equal to 1 from the equation (2). In the trimming circuit of the embodiment shown in FIG. 2, the target value is obtained by setting the resistances so that Rt=Rm=Runit is satisfied.

In the unit u4 having a target value of ΔR=Runit/4, n is equal to 4. As shown in FIG. 4(*a*), if m=1 is satisfied, t is equal to 3 from the equation (2). If m=2 is satisfied, t is equal to ½. Therefore, when m is 1 or 2, the target value is obtained by using four resistors R. The configuration of the unit u4 is determined so that the resistance Rt increases. In this embodiment, the resistance Rt when m=1 is satisfied is greater than the resistance Rt when m=2 is satisfied. Therefore, the unit u4 is configured so that m=1 is satisfied.

In the unit u5 having a target value of ΔR=Runit/8, n is equal to 8. As shown FIG. 4(*b*), if m=1 is satisfied, t is equal to 7. If m=2 is satisfied, t is equal to 3/2. If m=4, t is equal to ¼. Therefore, in order to form the unit u5, eight resistors R are required to satisfy m=1, five resistors R are required to satisfy m=2, and eight resistors R are required to satisfy m=4. As a result, the target value is obtained with the minimum number of resistors R when m=2 is satisfied.

In the unit u6 having a target value of ΔR=Runit/16, n is equal to 16. As shown in FIG. 4(*c*), if m=1 is satisfied, t is equal to 15. If m=2 is satisfied, t is equal to 7/2. If m=4 is satisfied, t is equal to ¾. Therefore, in order to form the unit u6, 16 resistors R are required to satisfy m=1, seven resistors R are required to satisfy m=2, and eight resistors R are required to satisfy m=4. Consequently, the target value is obtained with the minimum number of resistors R when m=2 is satisfied.

Figure 2:
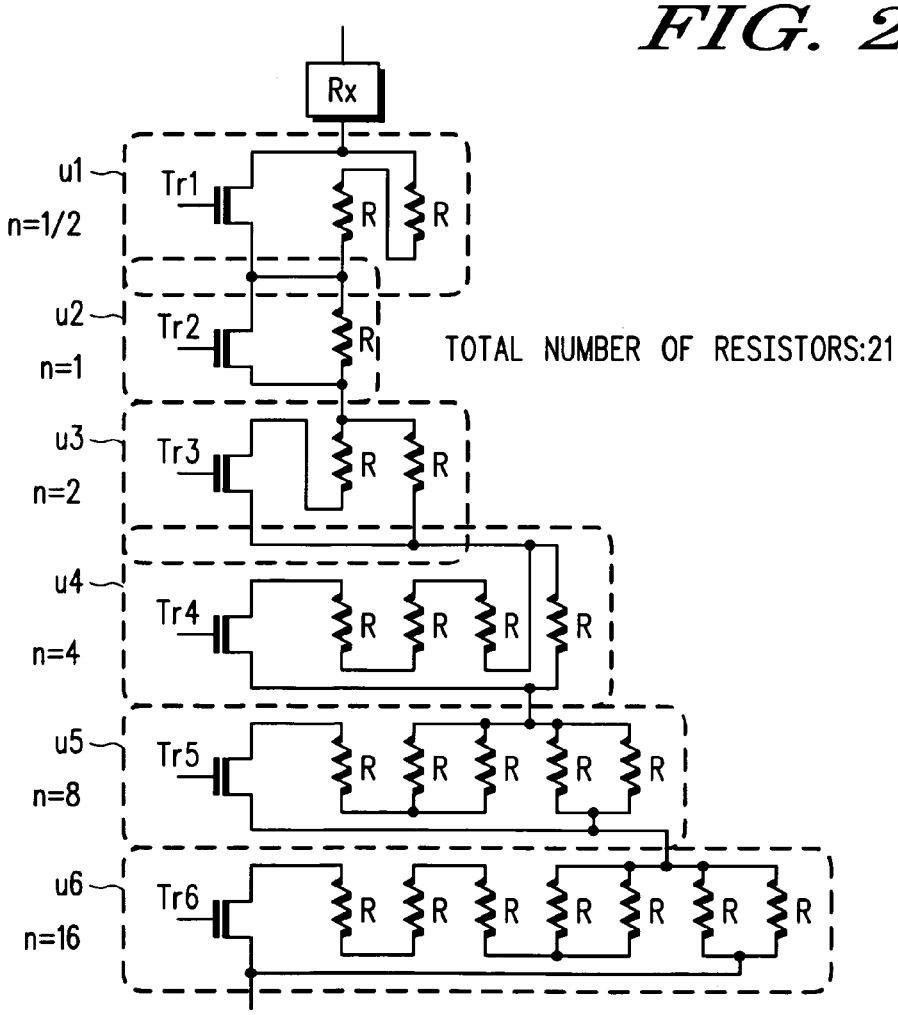
FIG. 2 is a circuit diagram of a trimming circuit according to the embodiment of the present invention.

Thus, in the trimming circuit of this embodiment shown in FIG. 2, the units u3 to u6 are respectively formed by two, one, two, four, five, and seven resistors R. Thus, the trimming circuit of this embodiment is formed by a total of 21 resistors R.

The effect of the resistance Ron of the transistor Tr6 is small. The unit affected by the resistance Ron in the trimming circuit, that is, the unit u6 having the minimum adjusting resistance ΔR will now be discussed. Assuming that the resistance Ron when the transistor Tr6 is turned on is Runit/16, the resistance of the unit u6 would be 57Runit/130 when the transistor Tr6 is turned on. Accordingly, the adjusting resistance ΔR of the unit u6 would be changed to 4Runit/65, and the difference when the resistance Ron is equal to zero would be Runit/1040. Consequently, the effect of the resistance Ron is extremely small.

This embodiment has the advantages described below.

In this embodiment, the units are each formed by a series-connected resistor circuit (first module), which has resistance Rt and which is connected in series to a transistor Trn, and a parallel-connected resistor circuit (second module), which has resistance Rm and which is connected in parallel to the transistor Trn and the series-connected resistor circuit. Thus, trimming is not performed with an absolute resistance resulting from the switching operation of the transistor Trn. Rather, the trimming circuit is formed by using the difference in resistance resulting from the switching operation (adjusting resistance ΔR). Therefore, greater flexibility is ensured for the circuit configuration in comparison with when the units are formed by parallel connections or serial connections.

Specifically, the resistances Rm and Rt are obtained from the equation (2), and the configuration of the trimming circuit is determined such that the total number of resistors R required to obtain the resistances Rm and Rt is small. The trimming circuit is thus formed with a smaller number of resistors R than in the prior art.

In this embodiment, the series-connected resistor circuit, which has resistance Rt, is connected in series to the transistor Trn in the units u3 to u6. Therefore, even when the transistor Trn is turned on, the effect of the resistance Ron of the transistor Trn on the adjusting resistance is reduced since the trimming circuit is configured with the series-connected resistor circuit having resistance Rt. This is particularly effective when the resistance Rt of the series-connected resistor circuit is much greater than the resistance Ron.

In this embodiment, in the unit u4, the target value is obtained with the four resistors R when m is 1 or 2 in the equation (2). The configuration of the unit u4 is determined so that the resistance Rt increases. In this embodiment, the resistance Rt when m=1 is satisfied is greater than the resistance Rt when m=2 is satisfied. Therefore, the unit u4 is configured so as to satisfy m=1. If the minimum total numbers of the resistors R for resistances Rm and Rt are the same, the configuration is determined such that the resistance Rt of the series-connected resistor circuit is greater. Therefore, the resistance Rt of the series-connected resistor circuit connected in series to the transistor Tr4 is high enough to minimize the effect of the resistance Ron when the transistor Tr4 is turned on.

In this embodiment, the units u1 to u6 respectively change the adjusting resistances of 2Runit, Runit, Runit/2, Runit/4, Runit/8, and Runit/16. Thus, the adjusting resistance ΔR of ½^i is generated, and the resistance is adjusted in a stepped manner.

It should be apparent to those skilled in the art that the present invention may be embodied in many other specific forms without departing from the spirit or scope of the invention. Particularly, it should be understood that the present invention may be embodied in the following forms.

In the above embodiment, each of the units u3 to u6 has the transistor Trn connected in series to the series-connected resistor circuit, which has resistance Rt. However, there is need for only one of the units, which configure the trimming circuit, to include a series-connected resistor circuit. It will be particularly effective if a series-connected resistor circuit is provided in a unit having a small adjusting resistance in which the resistance Ron of the transistor Trn may affect the adjusting resistance.

In the above embodiment, the units u1 to u6 respectively generate adjusting resistances of 2Runit, Runit, Runit/2, Runit/4, Runit/8, and Runit/16. However, the adjusting resistances are not limited in this manner. For example, the present invention may be applied to a trimming circuit including units generating smaller adjusting resistances (e.g., Runit/32 and Runit/64).

In the above embodiment, the trimming circuit is applied to a reference voltage generating circuit of a semiconductor device. However, the present invention is not limited in such manner, and the trimming circuit may be applied to other electronic circuits to function as a circuit for finely adjusting the electric characteristics.

The present examples and embodiments are to be considered as illustrative and not restrictive, and the invention is not to be limited to the details given herein, but may be modified within the scope and equivalence of the appended claims.

What is claimed is:

1. A trimming circuit for generating an adjusting resistance, comprising:

a base resistance circuit;

a first unit, connected to the base resistance circuit, including a first transistor and first and second series connected resistors, wherein the first transistor is connected in parallel with the first and second resistors;

a second unit, connected to the first unit, including a second transistor and a third resistor, wherein the third resistor is connected in parallel to the second transistor; and a third unit, connected to the second unit, including a third transistor, a series connection section connected in series with the third transistor, and a parallel connection section connected in parallel with the series connection section and the third transistor.

2. The trimming circuit of claim 1, wherein the first and second resistors each have a resistance R and wherein when the first transistor is off, the resistance of the first unit is 2R and when the first transistor is on, the resistance of the first unit is about zero.

3. The trimming circuit of claim 2, wherein the third resistor has a resistance R, and wherein when the second transistor is off, the resistance of the second unit is R and when the second transistor is on, the resistance of the second unit is about zero.

4. The trimming circuit of claim 3, wherein the trimming circuit includes six units having respective predetermined resistances of 2R, R, R/2, R/4, R/8 and R/16.

5. The trimming circuit of claim 1, wherein the third transistor is an NMOS transistor.

6. The trimming circuit of claim 1, wherein the base resistance circuit converts an output current to a reference voltage.

* * * * *